US011331779B2

(12) United States Patent
Iijima et al.

(10) Patent No.: US 11,331,779 B2
(45) Date of Patent: May 17, 2022

(54) DRIVING MACHINE

(71) Applicant: Koki Holdings Co., Ltd., Tokyo (JP)

(72) Inventors: Yoshimitsu Iijima, Ibaraki (JP); Hiroki Kitagawa, Ibaraki (JP)

(73) Assignee: Koki Holdings Co., Ltd., Tokyo (JP)

( * ) Notice: Subject to any disclaimer, the term of this patent is extended or adjusted under 35 U.S.C. 154(b) by 156 days.

(21) Appl. No.: 16/798,437

(22) Filed: Feb. 24, 2020

(65) Prior Publication Data

US 2020/0189079 A1 Jun. 18, 2020

Related U.S. Application Data

(63) Continuation of application No. 15/413,421, filed on Jan. 24, 2017, now Pat. No. 10,569,402.

(30) Foreign Application Priority Data

Jan. 26, 2016 (JP) ..... 2016-012859

(51) Int. Cl.
*B25C 1/00* (2006.01)
*B25C 1/04* (2006.01)

(52) U.S. Cl.
CPC ..... *B25C 1/008* (2013.01); *B25C 1/043* (2013.01)

(58) Field of Classification Search
CPC ... B25C 1/008; B25C 1/04; B25C 1/041–047; B25C 1/06; B25C 1/08; B25F 5/00; H01H 47/004
USPC ..... 227/8, 2, 3, 4, 6, 7, 130, 120; 173/1, 2, 173/170, 217
See application file for complete search history.

(56) References Cited

U.S. PATENT DOCUMENTS 4,509,668 A * 4/1985 Klaus ..... B25C 1/008 227/130
4,915,013 A * 4/1990 Moraht ..... B25C 1/043 227/130
5,522,532 A * 6/1996 Chen ..... B25C 1/008 227/130
5,669,542 A * 9/1997 White ..... B25C 1/042 227/130
6,604,664 B2 * 8/2003 Robinson ..... B25C 1/008 227/120
7,152,773 B2 * 12/2006 Ke ..... B25C 1/043 227/8
7,175,064 B2 * 2/2007 Schell ..... B25C 1/005 227/120
7,213,733 B1 * 5/2007 Wen ..... B25C 1/008 227/142
7,255,257 B2 * 8/2007 Oouchi ..... B25F 5/00 227/130
7,464,843 B2 * 12/2008 Huang ..... B25C 1/04 173/170

(Continued)

*Primary Examiner* — Valentin Neacsu
(74) *Attorney, Agent, or Firm* — JCIPRNET

(57) ABSTRACT

The disclosure discloses a driving machine includes a trigger, a first switch turned on or off by an operation of the trigger, a push lever that moves in response to an operation of pressing an ejection port of a fastener against a driven material, and a second switch turned on or off by movement of the push lever. The driving machine drives the fastener when the first switch and the second switch are both in the ON state. The trigger includes a switching mechanism to switch between a single-shot driving mode and a continuous-shot driving mode.

10 Claims, 11 Drawing Sheets

(56) References Cited

U.S. PATENT DOCUMENTS 7,810,688 B2 * 10/2010 Wu ..... B25C 1/008 227/8
7,931,180 B2 * 4/2011 Lai ..... B25C 1/047 227/8
8,347,978 B2 * 1/2013 Forster ..... B25C 1/06 173/1
8,348,118 B2 * 1/2013 Segura ..... B25C 1/008 227/130
8,800,835 B2 * 8/2014 Perron ..... B25C 1/008 227/8
9,381,633 B2 * 7/2016 Moore ..... B25C 1/06
9,486,907 B2 * 11/2016 Birk ..... B25C 1/008
9,550,288 B2 * 1/2017 Moore ..... B25C 1/008
9,662,776 B2 * 5/2017 Puppala ..... B25C 1/008
9,782,879 B2 * 10/2017 Bauer ..... B25C 1/04
10,213,911 B2 * 2/2019 Moore ..... B25C 1/043
2002/0125290 A1 * 9/2002 Robinson ..... B25C 1/043 227/8
2005/0077064 A1 * 4/2005 Oouchi ..... B25B 21/023 173/93.5
2005/0217875 A1 * 10/2005 Forster ..... B25C 1/06 173/1
2006/0213945 A1 * 9/2006 Ke ..... B25C 1/043 227/8
2008/0185415 A1 * 8/2008 Huang ..... B25C 1/04 227/8
2009/0159633 A1 * 6/2009 Wu ..... B25C 1/008 227/8
2009/0314818 A1 * 12/2009 Segura ..... B25C 1/008 227/8
2010/0012700 A1 * 1/2010 Perron ..... B25C 1/008 227/8
2010/0252608 A1 * 10/2010 Lai ..... B25C 1/047 227/8
2010/0276467 A1 * 11/2010 Kramer ..... B25C 1/047 227/8
2013/0240229 A1 * 9/2013 Forster ..... B25F 5/00 173/20
2014/0110452 A1 * 4/2014 Moore ..... B25C 1/043 227/8
2014/0197220 A1 * 7/2014 Birk ..... B25C 1/008 227/8
2014/0231485 A1 * 8/2014 Bauer ..... B25C 1/04 227/8
2015/0165611 A1 * 6/2015 Puppala ..... B25C 1/008 227/8
2016/0114470 A1 * 4/2016 Weigmann ..... B25C 1/008 227/8
2016/0151900 A1 * 6/2016 Wu ..... B25C 1/043 227/130
2019/0099871 A1 * 4/2019 Fukushima ..... B25C 1/047

* cited by examiner trigger arm 13 at the first position trigger arm 13 at the second position single-shot
driving mode continuous -shot
driving mode continuous -shot mode (when the push lever is pressed first, part 1)

single-shot mode (when the trigger lever is pulled first)

single-shot mode (when the push lever is pressed first, part 1)

single-shot mode (when the push lever is pressed first, part 1)

DRIVING MACHINE

This application is a continuation application of and claims priority benefit of a prior application Ser. No. 15/413,421, filed on Jan. 24, 2017, now allowed. The prior application Ser. No. 15/413,421 claims the priority benefit of Japanese Patent Application No. 2016-012859, filed on Jan. 26, 2016. The entirety of each of the above-mentioned patent applications is hereby incorporated by reference herein and made a part of this specification.

BACKGROUND OF THE INVENTION

Field of the Invention

The invention relates to a driving machine that drives a fastener, such as a nail, by cooperative action of two switch mechanisms, which include a first switch operated by a trigger and a second switch operated by a push lever that moves in response to an operation of pressing a front end of an ejection port of the fastener against a driven material. In the driving machine, a driving switching mechanism for switching between a single-shot driving operation and a continuous-shot driving operation is mounted to the trigger portion.

Description of Related Art

The commonly-known portable driving machine sequentially drives out fasteners that are loaded in a magazine from the front end of a driver blade by utilizing a driving source (power source), such as a compressed air system which uses air pressure by supplying compressed air from an air compressor to the driving machine main body, a gas combustion system in which the driving machine main body is equipped with a small gas cylinder for burning gas stored in the cylinder, an electric motor system in which the driving machine main body is equipped with a storage battery and an electric motor so as to use the driving force of the electric motor, and so on. For this type of driving machine, it is conventional to dispose a safety mechanism, as disclosed in Patent Literature 1, which constantly urges the push lever toward the side of the bottom dead center (the side of the driven material) with respect to the front end of the nose in the initial state, such that when the driven material is not in contact with the push lever of the ejection part front end, the striking driving part would not be activated even if the trigger is pulled. Such a system performs the operation while the front end of the push lever (contact arm) is pressed against the driven material. Therefore, it is possible to perform the so-called continuous driving operation in the case of sequentially driving multiple nails. That is, in the state where the trigger is not released after one nail is driven, the main body is moved to move and press the push lever against the next driving position, so as to sequentially and continuously drive multiple nails.

PRIOR ART LITERATURE

Patent Literature

Patent Literature 1: Japanese Patent Publication No. 2012-115922

SUMMARY OF THE INVENTION

Problem to be Solved

According to the technology of Patent Literature 1, the operation mode switching mechanism for switching between the single-shot driving mode and the continuous-shot driving mode is disposed on the push lever mechanism side instead of the trigger side. This system has the advantage that it does not complicate the structure inside the trigger, but the operation mode switching mechanism needs to be disposed near the upper end of the push lever and thus an installation space is required. Therefore, it may have adverse effects when the driving machine is to be made smaller and lighter. In addition, the inventors' study has found that in the case of the so-called two-switch system driving machine, in which the switches (valve mechanisms) of two systems, i.e., the trigger having a first switch for activating the striking driving means and a second switch that is turned on and off by the push lever, are disposed in parallel, installing the operation mode switching mechanism on the trigger part side may be advantageous as a whole.

Accordingly, in the invention, the switching mechanism for switching between the single-shot driving mode and the continuous-shot driving mode is disposed on the trigger part side of the driving machine, which performs the trigger operation through two switches and, in the state where the trigger remains to be pulled, moves the push lever from the bottom dead center to the top dead center, so as to enable the continuous-shot driving operation of fasteners. Furthermore, the invention reduces the number of parts on the push lever side that are for operating the second switch to simplify the configuration, so as to provide the driving machine with improved disassembly workability and assembly workability.

Solution to the Problem

Representative features of the invention disclosed in this application are explained as follows. The invention provides a driving machine, which includes a driver blade that strikes a fastener such as a nail; a striking driving element causing the driver blade to reciprocate; a first switch for activating the striking driving element; a trigger operated by an operator to set the first switch to an ON state or an OFF state; a push lever supported to be movable in a direction parallel to a movement direction of the driver blade and moving in response to an operation of pressing a front end of an ejection port of the fastener against a driven material; and a second switch opened and closed by a movement of the push lever and set to an ON state when the push lever is at a top dead center and set to an OFF state when the push lever is at a bottom dead center. The driving machine drives the fastener with the striking driving element when the first switch and the second switch are both in the ON state. A driving switching mechanism is disposed for switching between a single-shot driving mode, which drives one fastener every time the trigger is pulled, and a continuous-shot driving mode, which drives the fasteners continuously by repeatedly pressing the push lever against the driven material and releasing the push lever in a state of keeping the trigger pulled. The driving switching mechanism is disposed on the trigger side. The trigger includes a trigger lever that is swingable around a swing shaft. The driving switching mechanism includes a movable member that is disposed in the trigger lever and is in contact with a plunger of the first switch. The movable member is movable relative to the trigger lever and can be positioned at one of a first position and a second position, wherein the first position is where the plunger is not operated by an operation of the trigger lever and the second position is where the plunger is operated by the operation of the trigger lever.

According to another feature of the invention, the striking driving element moves a piston that is connected to the driver blade by compressed air, and the first switch is a switching valve of an air flow path, which serves as a trigger to supply the compressed air to the piston, and is operated by the trigger lever. Moreover, the second switch is a switching valve interposed in series in the air flow path and performs opening and closing operations by the movement of the push lever. Here, in the single-shot driving mode, after the fastener is driven, the movable member moves from the second position to the first position, such that the first switch is not operated. Thereby, while the operator keeps the trigger pulled, even if the driving machine is moved and the push lever is pressed against the next driving position, the striking of the fastener is not carried out. On the other hand, in the continuous-shot driving mode, after the fastener is driven, the movable member remains at the second position to maintain the first switch in an operable state. Accordingly, while the operator keeps the trigger pulled, the driving machine is moved and the push lever is pressed against the next driving position to carry out the striking operation of the fastener. Thus, the fasteners can be driven sequentially.

According to another feature of the invention, the movable member is a swing type arm and is swingable by a predetermined angle around a rotating shaft that is disposed in the trigger lever. A direction in which a swing end of the trigger lever extends from the swing shaft and a direction in which a swing end of the movable member extends from the rotating shaft are opposite directions, and a switching member may be disposed in the trigger lever to allow or prevent swing of the movable member. The switching member is of a rod type that is disposed substantially in parallel to the rotating shaft. A guiding groove is disposed to partially overlap a swing range of the movable member when viewed in an axial direction of the rotating shaft, and the switching member is moved inside the guiding groove in a longitudinal direction of the movable member. The switching member can set one of a single-shot position and a continuous-shot position, wherein the single-shot position is where the movable member is movable between the first position and the second position, and the continuous-shot position is where the movable member is fixed to the second position.

According to yet another feature of the invention, in the single-shot driving mode, if the trigger is operated after the push lever is pressed against the driven material, the movable member moves from the first position to the second position due to contact with the push lever to be able to move the plunger of the first switch. On the other hand, if the trigger is operated before the push lever is pressed against the driven member, because the movable member and the push lever are in a non-contact state, the movable member remains at the first position and is not able to move the plunger of the first switch. In addition, when the fastener is driven in the single-shot driving mode, the movable member and the push lever are released from a contact state by releasing the push lever from a state of being pressed against the driven material, and the movable member returns to the first position from the second position by a force of an urging spring.

Effects of the Invention

According to the invention, the driving switching mechanism is disposed on the trigger side. Thus, the configurations of the push lever mechanism, the push valve on the second switch side, and so on can be simplified to facilitate the disassembly or assembly work. Moreover, the driving switching mechanism is disposed on the trigger side, particularly, on the trigger lever. Therefore, the device main body can be made compact to achieve a driving machine that is easy to use. The aforementioned and other novel features of the invention can be understood through the description of the specification and the figures below.

DESCRIPTION OF THE EMBODIMENTS

First Embodiment

Figure 1:
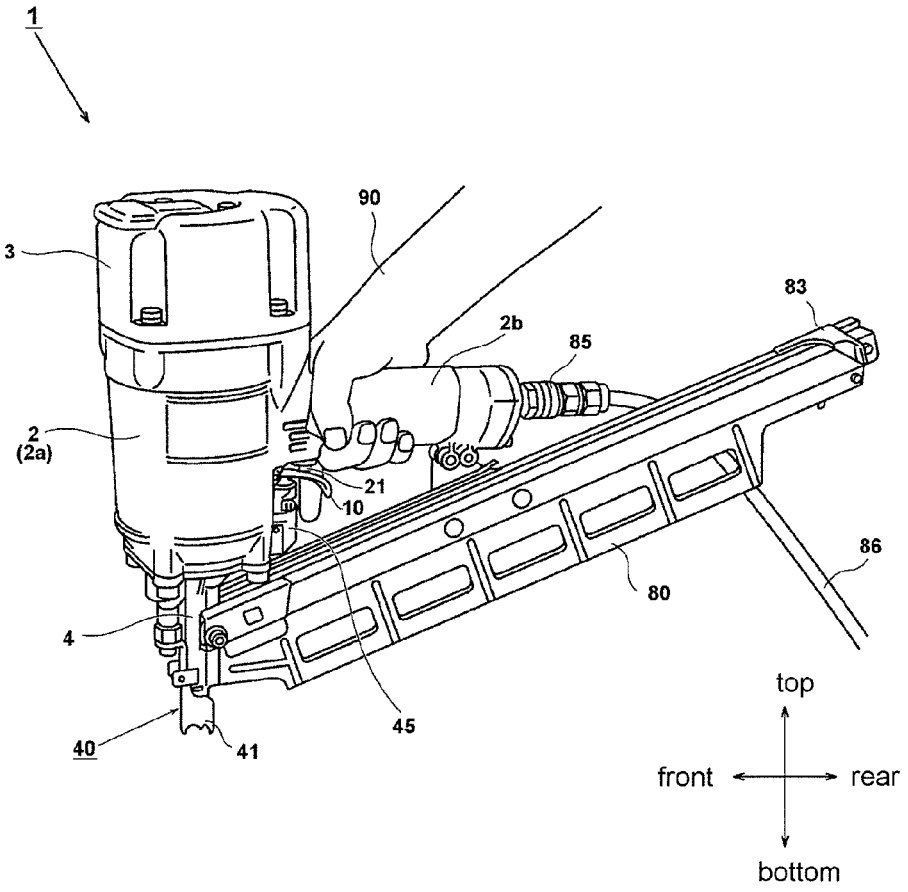
FIG. 1 is a perspective view showing the exterior of the driving machine 1 according to an embodiment of the invention.

Hereinafter, embodiments of applying the invention to a nail driving machine that uses a compressed air system as the driving source are described with reference to the figures. In all the figures for illustration of the embodiments, members having the same function are assigned with the same reference numerals and the repeated descriptions will be omitted. Moreover, in the following embodiments, for convenience, the vertical and horizontal directions are defined as shown in the figures based on a state where the driving machine is disposed to make the direction in which the fastener is driven vertically downward. Nevertheless, the actual direction of driving nails may be the horizontal direction or other directions.

FIG. 1 is a perspective view showing the exterior of a driving machine 1 of this embodiment. In the driving machine 1, a nose member 4 for guiding nails to be driven to an ejection direction side is attached below a body part 2*a* of a housing 2. An outer case (the housing in a broad sense) of the driving machine 1 includes the substantially cylindrical body part 2*a* that covers a space in which a piston (to be described later) reciprocates, a handle part 2*b* that extends from the body part 2*a* in a direction substantially perpendicular to the ejection direction, a top cover 3 that covers an opening on one axial end side (upper side) of the body part 2*a*, and the nose member 4 that covers an opening on the other axial end side (lower side) of the body part 2*a*. The handle part 2*b* is the portion to be held by an operator and is a substantially cylindrical portion that houses therein an accumulation chamber (not shown) for compressed air. A connector 85 is provided at the rear end of the handle part 2*b*, and the compressed air is supplied from an external compressor (not shown) via an air hose 86. The nose member 4 uses a material that is obtained by applying a heat treatment to an alloy steel raw material, and an ejection passage (not shown) is disposed therein for the nail driven by a driver blade (to be described later) to pass through. Moreover, an opening (not shown) is formed on a portion of a side surface of the nose member 4 for sequentially feeding the nails. An end side of a magazine 80 for supplying the nails is attached to surround the opening.

The magazine 80 is disposed in a manner that the longitudinal direction thereof (feeding direction) is slightly oblique with respect to the ejection direction, and is disposed in a manner that an end on a nail discharge side is attached to the nose member 4 and an end on a nail supply side is on a side away from the nose member 4 and located rearward and obliquely upward with respect to the handle part 2*b*. The magazine 80 feeds nails (not shown) connected by a tensile force of a spiral spring (not shown) to the side of the nose member 4. The figure illustrates a state where a feeder knob 83 is pulled to a position near the rear end of the magazine 80 in the feeding direction.

A push lever 40 is disposed at a front end of the nose member 4. The push lever 40 is a movable mechanism that is movable in a predetermined range in the same direction as the ejection direction and the opposite direction with respect to the nose member 4, and moves upward in response to an operation of pressing the front end of the nose member 4 against the driven material. By two operations, i.e., the condition where a front end member 41 that constitutes the push lever 40 is pressed against an object (the driven material) into which the nail is to be driven and the pulling of a trigger lever 11, the operator is able to activate the striking driving element that generates the reciprocating motion to drive the nail.

A trigger 10 is disposed on the lower side near a base of the handle part 2*b* toward the body part 2*a*. A guard member 45 made of a synthetic resin for covering a movable portion of the push lever 40 is disposed near the lower side of the trigger 10 on the side of the body part 2*a*. FIG. 1 illustrates a state before the operator pulls the trigger 10 with the index finger of a right hand 90 that holds the handle part 2*b*. Here, in this specification, pulling the trigger 10 or the trigger lever (to be described later) means that the trigger lever is moved toward the side (upward) opposite to a driving direction. Moreover, opening or releasing the trigger lever of the trigger 10 means that the trigger lever is moved downward by an urging spring (not shown).

Figure 2:
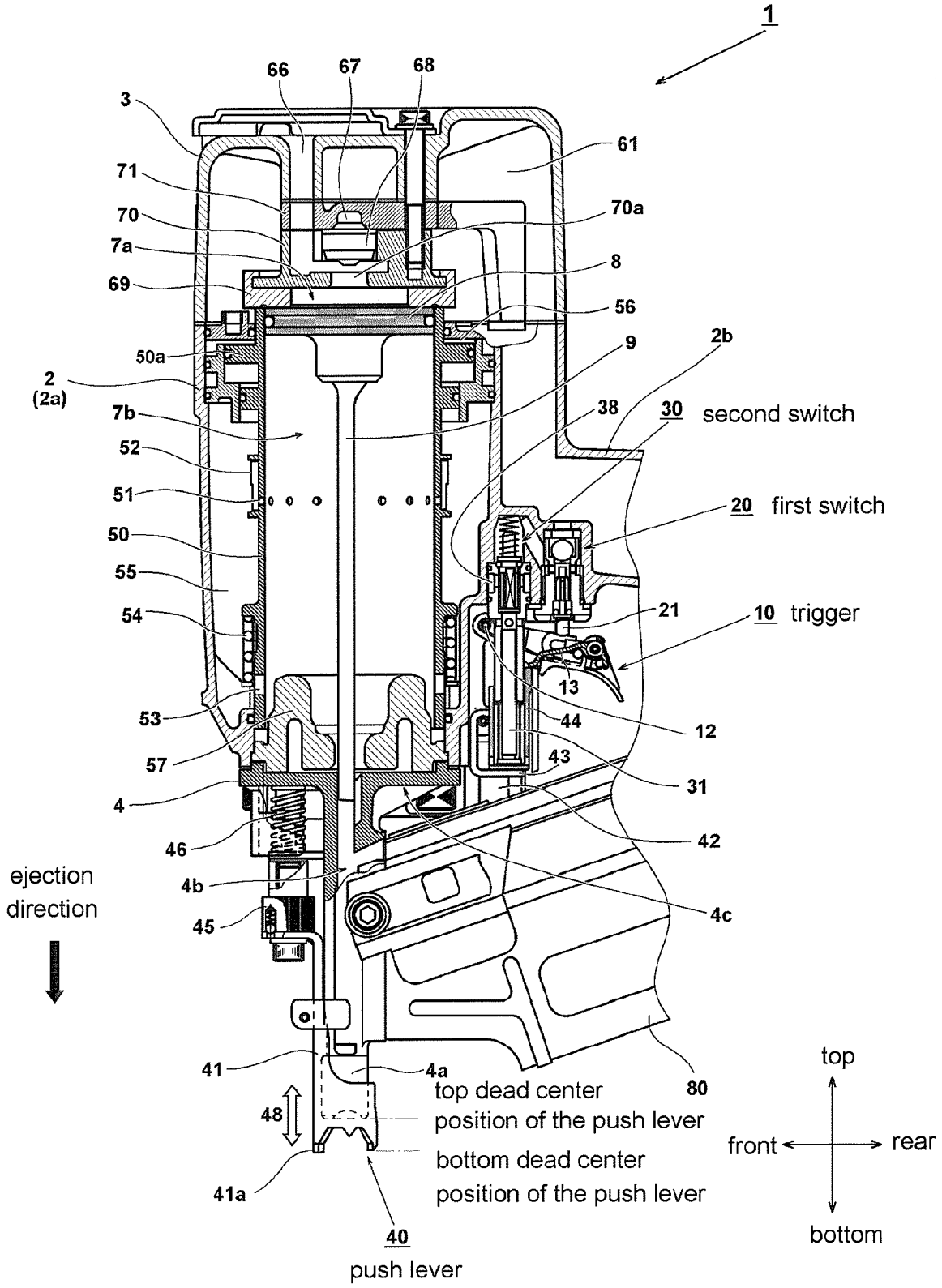
FIG. 2 is a longitudinal cross-sectional view showing the internal structure of the driving machine 1 according to an embodiment of the invention.

FIG. 2 is a longitudinal cross-sectional view showing the structure of the main parts of the driving machine 1 according to an embodiment of the invention. The outer case of the driving machine 1 includes the housing 2 that is substantially T-shaped in a side view, the top cover 3 that covers the opening on one side (upper side) of the cylindrical body part 2*a* of the housing 2, the nose member 4 attached to the opening on the other side (lower side), and the handle part 2*b* that extends from the body part 2*a* of the housing 2 in the substantially perpendicular direction. An accumulation chamber 61 for storing compressed air that comes from a compressor (not shown) is formed inside the handle part 2*b* and inside the top cover 3.

Inside the driving machine 1, a cylindrical cylinder 50, a piston 8 that is capable of sliding (reciprocating) up and down in the cylinder 50, and a driver blade 9 connected to the piston 8 are disposed. The driver blade 9 is for striking a fastener, such as a nail, and is disposed to extend downward from the lower end side of the cylindrical cylinder 50. The driver blade 9 may be manufactured integrally with the piston 8 or separately.

The cylinder 50 is slightly movable in the downward direction by the force of the compressed air and slidably supports the piston 8 on the inner surface. A return air chamber 55 that accumulates compressed air for returning the driver blade 9 to a top dead center is formed on a lower outer periphery of the cylinder 50. A plurality of air holes 51 are formed in an axial center portion of the cylinder 50, and a check valve 52 is provided there. The air holes 51 allow the compressed air to flow in only one direction from the inner side of the cylinder 50 to the return air chamber 55 on the outer side. Moreover, an air passage 53 that is constantly open to the return air chamber 55 is formed on the lower side of the cylinder 50. A piston bumper 57 is disposed at the lower end of the cylinder 50. The piston bumper 57 has a through hole in the center, into which the driver blade 9 is inserted. The piston bumper 57 is composed of an elastic body, such as rubber, for absorbing the excess energy of the rapid downward movement of the piston 8 after nail driving.

The piston 8 is disposed to be vertically slidable in the cylinder 50. The driver blade 9 is formed integrally with the piston 8 so as to extend downward from the approximate center of the lower surface of the piston 8. Thus, the inside of the cylinder 50 is divided into a piston upper chamber 7*a* and a piston lower chamber 7*b* by the piston 8. The upper chamber 7*a* of the piston 8 is formed under a head cap 69, which abuts on the upper end of the cylinder 50. The head cap 69 is disposed on the lower side of a valve holding member 70. A spring 54 that urges the cylinder 50 downward is disposed on the outer periphery of the cylinder 50.

At the time of driving, when a first switch 20 and a second switch 30 are turned on by an operation of the trigger 10, high pressure air flows into a space 67 from the accumulation chamber 61 and moves an exhaust valve 68 to the lower side to close an opening 70*a* of the valve holding member 70 so as to close an air passage 66 that communicates the piston upper chamber 7*a* with the atmosphere. Simultaneously, when the first switch 20 and the second switch 30 are turned on, the high pressure air from the accumulation chamber 61 is also supplied to a main valve chamber 56. Thus, the pressure on the upper surface of a flange portion 50*a* of the cylinder 50 rises rapidly and the cylinder 50 moves slightly to the lower side in the ejection direction against the force of the spring 54 that holds the cylinder 50 while urging the cylinder 50 upward. Then, since the upper opening of the cylinder 50 and the head cap 69 are separated and form a gap, the compressed air flows from the accumulation chamber 61 into the piston upper chamber 7*a* at once. The inflow of the compressed air causes the piston 8 and the driver blade 9 to move down rapidly, and the driver blade 9 slides in an ejection passage 4*b* to drive the nail (not shown) that has been fed into the ejection passage 4*b* to the driven material.

The nose member 4 guides the nail (not shown) and the driver blade 9 such that the driver blade 9 is in proper contact with the nail to be able to drive the nail into a desired position of the driven material. The nose member 4 includes a cylindrical portion 4*a* that has therein the ejection passage 4*b* for guiding the nail and the driver blade 9, and a flange portion 4*c* that closes the opening at the lower side of the body part 2*a*. Moreover, the push lever 40 that is vertically movable is disposed along the outer surface of the ejection passage 4*b*. The ejection passage 4*b* is formed to extend from the through hole formed in the flange portion 4*c* at the upper end to an ejection port (not shown) at the lower end, and a feeding port (not shown) for feeding nails from the magazine 80 is provided in the middle of the path.

The magazine 80 is arranged side by side to the handle part 2*b*. The magazine 80 is loaded with connected nails (not shown) that are connected in a strip. The connected nails are pressed toward the side of the ejection passage 4*b* by a coil spring or the like mounted in the magazine 80 to be driven one by one into the driven material by the driver blade 9.

The handle part 2*b* is the portion to be held by the operator. In a connection portion between the handle part 2*b* and the driving machine 1, as shown enlargedly in FIG. 2, the trigger 10 to be operated by the operator, the first switch 20 communicating with the accumulation chamber 61 (refer to FIG. 1) for opening or blocking the passage of the compressed air, and the second switch 30 communicating with the outlet side of the first switch 20 on one side and communicating with the passage leading to the main valve chamber 56 on the other side are disposed. The first switch 20 and the second switch 30 respectively include switching valves that allow or block airflow.

The trigger 10 is a mechanism that is operated directly by the operator, and performs switching between opening and closing of a trigger valve (to be described later) via a trigger plunger 21 of the first switch 20. Here, the trigger 10 is pivotally supported by the housing 2 to be swingable by a predetermined angle around a swing shaft 12. Nevertheless, the trigger 10 may also be a slide type trigger that moves in parallel to the vertical direction or may use other movable members to operate the trigger plunger 21.

The second switch 30 includes a push lever valve (to be described later) that allows or blocks flow of compressed air from the first switch 20 to the main valve chamber 56 by the push lever 40. The push lever 40 is movable in the direction of the arrow 48. Movement of the front end member 41 of the push lever 40 indicated by the arrow 48 is transmitted as vertical movement of a push lever plunger 31 on the side of the second switch 30 via a connection arm 42. The push lever 40 includes the front end member 41, the connection arm 42, a connection member 43, and a sleeve 44. These may be separate components, or part of or all of these components may be formed integrally. In addition, regarding the configuration of the push lever 40, some components may be omitted or other components may be added as long as the second switch 30 can be operated when the nose member 4 is pressed against the driven material. When the main body of the driving machine 1 is pressed against the driven material and causes the push lever 40 to move to a retracted position, i.e., the front end 41*a* is at a top dead center position, the second switch 30 allows the compressed air to flow from the side of the first switch 20 to the side of the main valve chamber 56. When the push lever 40 is at a normal position (a bottom dead center position), the second switch 30 is in a blocking state.

Next, operations of the first switch 20 and the second switch 30 are described with reference to FIG. 3(*a*) and FIG. 3(*b*). Two cylindrical holes 2*c* and 2*d* that extend upward from the bottom are formed at the bottom of the housing 2 near the base of the handle part 2*b*. A valve mechanism constituting the first switch is housed inside the cylindrical hole 2*c*. The inside of the cylindrical hole 2*d* is formed with a small-diameter portion and a large-diameter portion, and houses a valve mechanism that constitutes the second switch. Here, the movement directions of the valves for opening and closing the respective passages are parallel, and are arranged in parallel to the ejection direction of the nail.

Figure 3A:
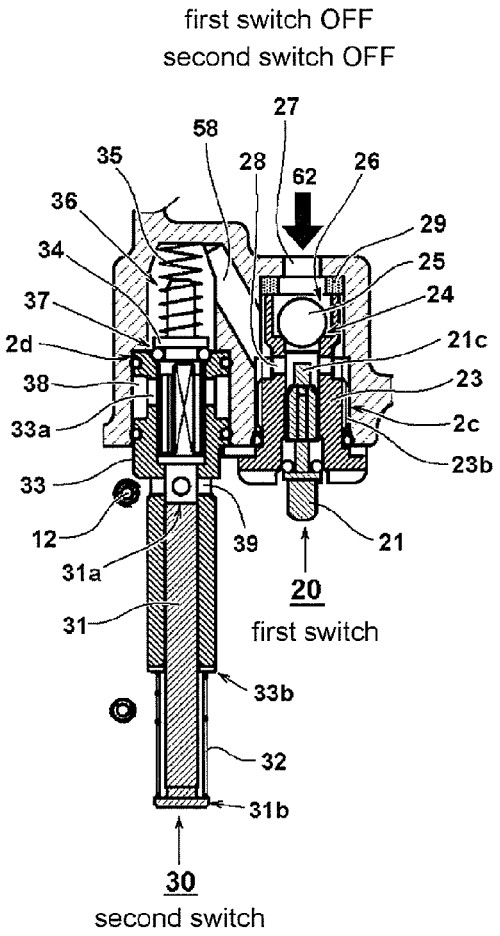
FIG. 3(*a*) and FIG. 3(*b*) are partially enlarged cross-sectional views of the first switch 20 and the second switch 30 of FIG. 2.
Figure 3B:
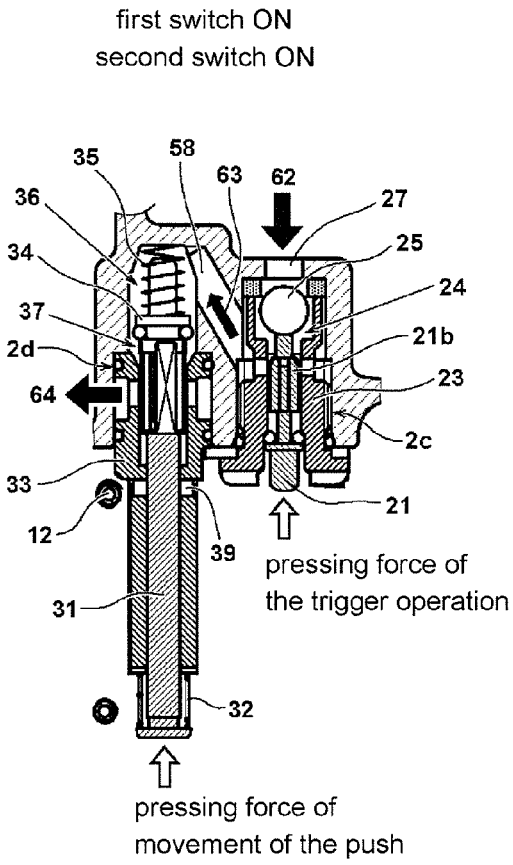

FIG. 3(*a*) illustrates a state where the first switch 20 and the second switch 30 are OFF (the state of blocking the air passage) and FIG. 3(*b*) illustrates a state where the first switch 20 and the second switch 30 are ON (the state of communicating the air passage). The first switch 20 and the second switch 30 are connected in series to allow the compressed air accumulated in the accumulation chamber 61 to flow in the direction of the arrow 62. When the first switch 20 is ON (communicating state), the air that has passed through the first switch 20 flows into a second valve chamber 36 on the side of the second switch 30 via an air passage 58, as indicated by the arrow 63. When the second switch 30 is ON (communicating state), the compressed air that has passed through the push lever valve 34, which serves as the valve mechanism of the second switch 30, is discharged from an opening 33*a* to the side of an air passage 38, as indicated by the arrow 64, and then flows to the side of the exhaust valve 68 and the main valve chamber 56, as shown in FIG. 2, via the predetermined path. In this way, the compressed air on the side of the accumulation chamber 61 passes through two switch means that are connected in series (valve mechanisms for blocking the airflow), so as to control start of the driving operation of the piston 8 that serves as the striking driving means.

The first switch 20 mainly includes a substantially cylindrical trigger bush 23, the trigger plunger 21 disposed in the trigger bush 23, and a substantially spherical valve member 25. The trigger bush 23 is screwed into a female screw formed in the cylindrical hole 2*c* by a male screw 23*b* that is formed on the outer peripheral side near the lower side. A packing 29 is interposed in the upper end portion of the trigger bush 23. The valve member 25 is housed in a first valve chamber 26 that communicates with the accumulation chamber 61 and the air passage 58, and blocks or opens the passage of air by opening or closing a stepped opening 24 formed on an inner diameter portion of the substantially cylindrical trigger bush 23. The opening 24 is an edge of a step portion that opens downward from the first valve chamber 26. The opening 24 has a diameter smaller than a diameter of the valve member 25. The valve member 25 is constantly urged, as indicated by the arrow 62, by the force of the compressed air from the side of the accumulation chamber 61. Accordingly, when the valve member 25 receives the downward pressure caused by the pressure of the compressed air in the accumulation chamber 61 via a through hole 27, the valve member 25 is engaged with the opening 24 and the first valve chamber 26 is closed. That is, the first switch 20 becomes a closed state (OFF).

The trigger plunger 21 is held to be movable vertically below the valve member 25. A front end part 21*c* of the trigger plunger 21 is a working piece for moving the valve member 25. A cross part 21*b* is formed near the center and a cross-sectional shape of the cross part 21*b* perpendicular to the axial direction is substantially cross-shaped, and since there exist a cylindrical inner wall portion of the trigger plunger 21 and a predetermined space, air is allowed to flow in the axial direction. Thus, when the opening 24 is opened, the air flows in the axial direction of the trigger plunger 21 to be discharged to the side of the air passage 58 from an opening 28. When the lower end of the trigger plunger 21 is pressed upward by the trigger 10 (refer to FIG. 1), the trigger plunger 21 presses the valve member 25 of the first switch 20 upward against the pressure of the compressed air and sets the first switch 20 to an opened state. As shown in FIG. 3(*b*), when the trigger plunger 21 is moved upward by the pressing force of the operation of the trigger 10, the valve member 25 is moved upward against the compressed air in the accumulation chamber 61 and thus is separated from the opening 24, by which the opening 24 that has been blocked is opened. That is, the first switch 20 becomes the opened state (the ON state of the air flow path) and the air flows in the direction of the arrow 63 from the arrow 62.

The second switch 30 mainly includes the substantially cylindrical push lever plunger 31 that is press-fitted into the cylindrical hole 2*d*, the push lever valve 34 disposed in the push lever plunger 31, and a coiled plunger spring 35 that urges the push lever valve 34 in a predetermined direction. The push lever valve 34 is a valve for switching to block or allow flow of the compressed air from the air passage 58 to the air passage 38 in response to the operation of the push lever 40. A push lever bush 33 extends substantially vertically and has a tubular shape that has a passage therein. The second valve chamber 36 is a cylindrical space that serves as a movement space of the push lever bush 33. A flange-shaped portion of the push lever valve 34 abuts on an opening 37 formed at the upper end of the second valve chamber 36 to block the airflow (the state of FIG. 3(*a*)) or is separated to allow the airflow (the state of FIG. 3(*b*)). An opening 33*a* is formed on the outer peripheral side in the cylindrical space below the opening 37. The opening 33*a* communicates the air passage 38 with the second valve chamber 36. Then, when the push lever plunger 31 is lowered, a space is formed between the side of the push lever 40 on the lower side of the push lever valve 34 and the upper end 31 a, and an exhaust port 39 for releasing the compressed air to the atmosphere is formed on a wall surface of the push lever plunger 31.

Figure 4:
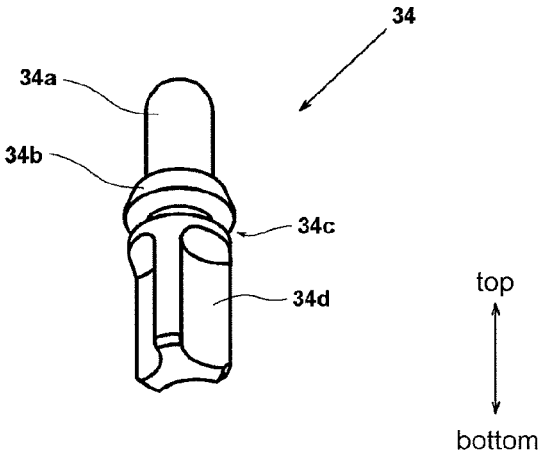
FIG. 4 is a perspective view showing the shape of the push lever valve 34 of FIG. 3(*a*) and FIG. 3(*b*) alone.

The push lever valve 34 moves in the vertical direction to open or close the opening 37 at the upper end of the push lever bush 33. About half of the push lever valve 34 is housed in the space on the upper side of the cylindrical push lever bush 33 and the push lever valve 34 moves to close or open the opening 37. Here, the shape of the push lever valve 34 is illustrated by the perspective view of FIG. 4. A columnar part 34*a* is formed on the upper side of the push lever valve 34, a flange part 34*b* is formed near the axial center, and a recessed part 34*d* where the outer peripheral surface is greatly recessed inward is formed on the lower side portion. The air flows from the second valve chamber 36 to the opening 33*a* (refer to FIG. 3(*a*) and FIG. 3(*b*)) via a gap between the recessed part 34*d* and the inner wall surface of the push lever valve 34. In addition, on the lower side of the flange part 34*b*, a groove 34*c* is formed continuous in the circumferential direction for disposing a sealing member, such as an O-ring. The columnar part 34*a* is disposed on the inner side of the coiled plunger spring 35. In this way, in the state where the lower side surface of the flange part 34*b* is in contact with the upper surface of the stepped opening 37 (the state of FIG. 3(*a*)), the flow path of the second switch 30 can be set to the closed state. The push lever valve 34 is urged downward by the plunger spring 35. Please revert to FIG. 3(*a*) and FIG. 3(*b*) again.

One end of the plunger spring 35 is held on the side of the housing 2 and the other end is in contact with the upper surface of the flange portion of the push lever valve 34, so as to urge the push lever valve 34 downward. The push lever plunger 31 moves vertically together with the push lever 40 to move the push lever valve 34. A flange part 31*b* having a diameter that expands to form a flange shape is formed at the lower end of the push lever plunger 31. A coiled spring 32 is interposed between the upper surface of the flange part 31*b* and a lower end surface 33*b* of the push lever bush 33 to urge the push lever plunger 31 downward.

When the trigger 10 is pulled in the state of collaboration with the push lever 40, the compressed air accumulated in the accumulation chamber 61 is supplied to the main valve chamber 56 and the exhaust valve 68 (both refer to FIG. 2) via the first switch 20 and the second switch 30. Therefore, a large amount of compressed air flows into the cylinder 50 and drives the piston 8 from the top dead center to the bottom dead center. Thereby, the driver blade 9 fixed to the piston 8 strikes the leading nail (not shown) that has been fed into the ejection passage 4*b* from the magazine 80 and drives it into the driven material from the front end of the nose member 4. After the nail is driven, one of the first switch 20 and the second switch 30 is set to the OFF state by releasing one of the trigger 10 and the push lever 40. Thus, supply of the compressed air from the side of the accumulation chamber 61 to the cylinder 50 is blocked immediately.

In this embodiment, as a premise, the trigger operation is achieved with use of two switches (valve mechanisms), i.e., the first switch 20 and the second switch 30. A "single-shot driving mode" and a "continuous-shot driving mode" are achieved by devising the configuration of the trigger 10. The "single-shot driving mode" is to drive the fastener every time the trigger 10 is pulled while the "continuous-shot driving mode" is to move the main body of the driving machine 1 vertically to continuously drive the fasteners when the trigger 10 remains to be pulled. In both modes, as long as the push lever 40 is not pressed against the driven material, namely, the push lever 40 is not positioned at the top dead center, the striking operation is not performed.

In the "single-shot driving mode," after one driving is completed, once the trigger 10 is temporarily released and is set to a trigger-off state, the next driving is not performed unless the trigger lever 11 is pulled again (of course, a requisite condition is the state where the push lever 40 is pressed against the driven material when the next driving operation is performed). In other words, in the state where the operator keeps the trigger 10 pulled without releasing it after completing the first driving, even if the main body of the driving machine 1 is moved to press the push lever 40 against the next driving position of the driven material, the first switch 20 is not set to the ON state. Thus, for the "single-shot driving mode," it is necessary to release the trigger operation once the driving of one nail is completed.

In the "continuous-shot driving mode," in the state where the operator keeps the trigger 10 pulled without releasing it after completing the first driving, when the operator moves the main body of the driving machine 1 and presses the push lever 40 against the next driving position of the driven material, the operator can drive the nail at that time. Therefore, in this embodiment, if the operator keeps the trigger 10 pulled without releasing it after completing the driving, the first switch 20 can be maintained in the ON state and flow of the compressed air can be opened and blocked by the side of the second switch 30.

Figure 5A:
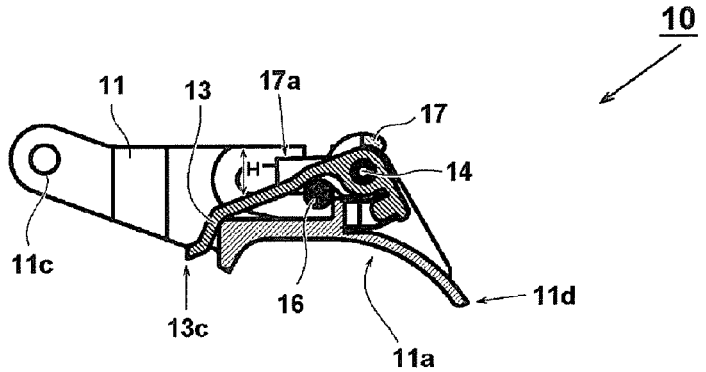
FIG. 5(*a*) and FIG. 5(*b*) are longitudinal cross-sectional views showing the structure of the trigger 10 of FIG. 2.
Figure 5B:
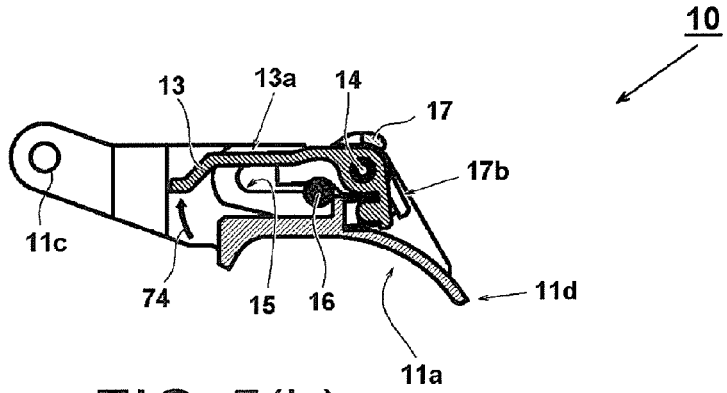

Next, the structure of the trigger 10 is described with reference to FIG. 5(*a*) to FIG. 7(*d*). FIG. 5(*a*) and FIG. 5(*b*) are longitudinal cross-sectional views showing the structure of the trigger 10. The position of a trigger arm 13 in FIG.

5(*a*) is a first position where the trigger plunger 21 is not operated (not operable) by the operation of the trigger lever 11, and the position of the trigger arm 13 in FIG. 5(*b*) is a second position where the trigger plunger 21 is operated (operable) by the operation of the trigger lever 11. The trigger 10 mainly includes the trigger lever 11 that is pivotally supported on the side of the housing 2, the trigger arm 13 that is relatively movable (rotatable) by a predetermined angle with respect to the trigger lever 11, and an elongated pin-shaped change rod 16 for limiting a moving angle of the trigger arm 13 that serves as the movable member. A guiding groove 15 that has a substantially L shape in the side view is formed on the trigger lever 11, and the change rod 16 is a metallic switching member that is capable of performing parallel movement while maintaining a parallel state with a rotating shaft 14 in the guiding groove 15. Here, the positional relationship, as viewed in the axial direction of the rotating shaft 14, is that a swing range of the change rod 16 overlaps a portion of the guiding groove 15. One of a single-shot position and a continuous-shot position can be set by the change rod 16, wherein the single-shot position sets the trigger arm 13 movable between the first position and the second position, and the continuous-shot position fixes the movable member to the second position. The basic configuration of the trigger lever 11 mainly includes a hole 11*c* that holds the swing shaft 12 having a rotation center (refer to FIG. 1), and an operation part 11*a* for the operator to perform the pulling operation of the trigger 10. During the driving, the operation part 11*a* moves counterclockwise around the swing shaft 12, i.e., upward, against the urging force of a torsion coil spring 18 (refer to FIG. 8(*a*) to FIG. 8(*c*) which will be described later), which is disposed to function around the swing shaft 12 in response to the pulling operation of the operator.

For the trigger 10 of this embodiment, the rotating shaft 14 is disposed within a swing radius of the trigger lever 11, and the trigger arm 13 is disposed to be swingable with a small swing radius from the rotating shaft 14. The direction in which the trigger lever 11 extends from the swing shaft 12 (refer to FIG. 1) and the direction in which a main surface portion (upper surface 13*a*) of the trigger arm 13 extends from the rotating shaft 14 are opposite directions. During the "single-shot driving mode," the trigger arm 13 is swingable around the rotating shaft 14 within the range from the state of FIG. 5(*a*) to the state of FIG. 5(*b*). The swing results from contact with the portion (a sleeve 44 to be described later with reference to FIG. 8(*a*) to FIG. 8(*c*)) that moves in conjunction with the push lever 40, and is in the direction of the arrow 74. The trigger arm 13 is in contact with the trigger plunger 21 on the upper surface 13*a*. In the state of FIG. 5(*b*), the trigger plunger 21 can be moved, but in the state of FIG. 5(*a*), the upper end position of the trigger lever 11 and the upper surface position of the upper surface 13*a* are away from each other and a recess of a distance H is formed. Due to the presence of the recess, the trigger plunger 21 cannot be pressed. Therefore, during the "single-shot driving mode," the trigger arm 13 is configured to be set to the first position of FIG. 5(*a*) and the second position of FIG. 5(*b*). At the time of the initial striking, after the trigger plunger 21 is pressed in the state of FIG. 5(*b*) to perform the driving operation, the trigger arm 13 returns to the state of FIG. 5(*a*), and as long as the trigger lever 11 is temporarily released and not pulled again, the trigger arm 13 does not become the state of FIG. 5(*b*). According to the configuration, in the "single-shot driving mode," it is necessary to return the trigger lever 11 to the original position and then pull the trigger lever 11 again after the driving. On the other hand, in order to achieve the "continuous-shot driving mode," the state of fixing the position of the trigger arm 13 to the position shown in FIG. 5(*b*) is maintained. Therefore, the change rod 16 is moved in the guiding groove 15 from the rear side to the front side. This operation will be described later with reference to FIG. 7(*a*) to FIG. 7(*d*).

Figure 6:
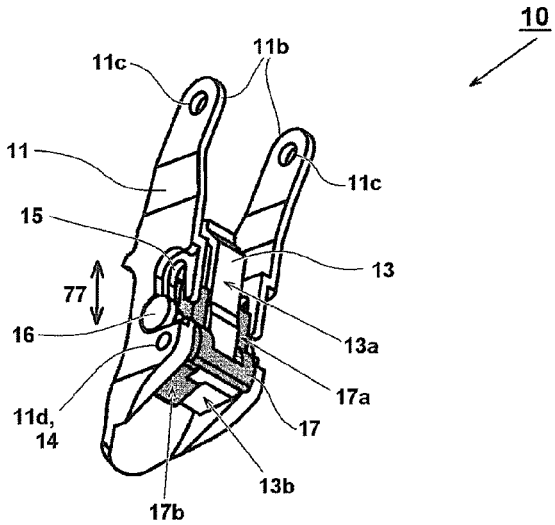
FIG. 6 is a perspective view showing the shape of the trigger 10 of FIG. 2.
Figure 7A:
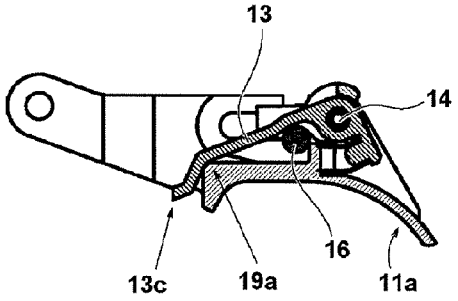
FIG. 7(*a*) to FIG. 7(*d*) are longitudinal cross-sectional views showing the operation of the driving switching mechanism in the trigger 10 of FIG. 2.
Figure 7B:
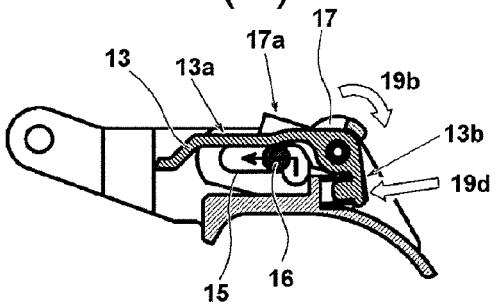
Figure 7C:
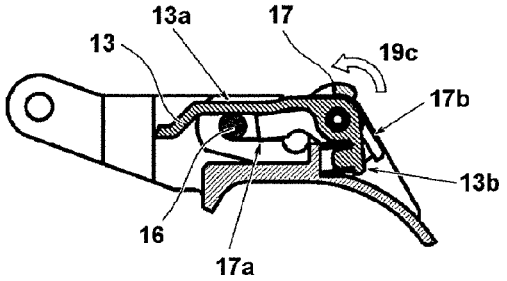
Figure 7D:
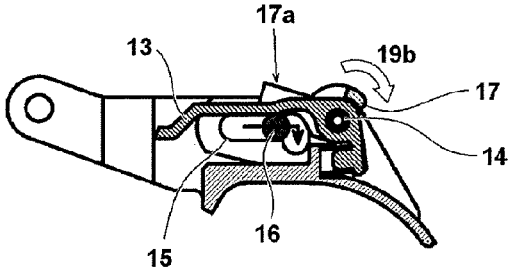

FIG. 6 is a perspective view showing a state where the trigger 10 alone is viewed obliquely from above. The front end parts of the trigger lever 11 on the side of the swing shaft 12 (refer to FIG. 1) are plate-shaped arm parts 11*b* that extend substantially in parallel in the left and right directions. The hole 11*c* for fixing the swing shaft 12 is formed on each of the two arm parts 11*b*. The substantially L-shaped guiding groove 15 is formed on a side surface of the trigger lever 11. The change rod 16 is disposed in the guiding groove 15. The change rod 16 has a columnar shape and two ends of the change rod 16 are flange-shaped. The change rod 16 is movable between one end (the state of FIG. 5(*a*) and FIG. 5(*b*)) and the other end (the position shown in FIG. 6(3) which will be described later) of the guiding groove 15, as indicated by the arrow 77, and is held on the side of either end by a stopper 17.

The trigger arm 13 is formed with the upper surface 13*a* and a rear piece 13*b*. The upper surface 13*a* is in contact with or is separated from the trigger plunger 21. The rear piece 13*b* can be pressed by the finger from the rear side so as to rotate the trigger arm 13. Here, although not illustrated in the figure, a spring means may be disposed for urging the trigger arm 13 to move in a predetermined direction, e.g., to the first position of FIG. 5(*a*). The stopper 17 is pivotally supported to be coaxial with the trigger arm 13 and is urged toward one side (the direction of the arrow 19*c* in FIG. 7(*c*) which will be described later) by a torsion coil spring (not shown) with the rotating shaft 14 as the rotation center. The operator can press a rear piece 17*b* or move a portion exposed around the rotating shaft 14 with a finger to rotate the stopper 17. A rotating shaft hole 11*d* for fixing the rotating shaft 14 that pivotally supports the trigger arm 13 and the change rod 16 is formed on two side surfaces on the rear side of the trigger lever 11.

Hereinafter, a method for switching between the "single-shot driving mode" and the "continuous-shot driving mode" is described with reference to FIG. 7(*a*) to FIG. 7(*d*). In FIG. 7(*a*), in the state of the "single-shot driving mode" as shown in FIG. 5(*a*), the change rod 16 is at the single-shot position and the trigger arm 13 is in contact with an upper surface 19*a* of the operation part 11*a* at the portion of the arrow 19*a* due to the urging force of a spring (not shown). In addition, the change rod 16 is located at the rear end that is farthest from the swing shaft 12. Here, the operator moves the stopper 17, as indicated by the arrow 19*b*, to press the rear piece 13*b* of the trigger arm 13 (refer to FIG. 5(*a*) and FIG. 5(*b*)) in the direction of the arrow 19*d*, so as to rotate the trigger arm 13 clockwise in the figure to the position shown in FIG. 7(*b*). In this state, the operator moves the change rod 16 in the direction of the arrow 19*c* to release the urging of the stopper 17 in the direction to the arrow 19*b*. Then, due to the function of the torsion coil spring (not shown), the stopper 17 rotates counterclockwise, as indicated by the arrow 19*c*, and returns to the original position, as shown in FIG. 7(*a*). As a result of the rotation, a front piece 17*a* of the stopper 17 is located behind the change rod 16 and thus the position of the change rod 16 is maintained at the front side of the guiding groove 15, which becomes the state of FIG. 7(*c*). In this state, at the position of the "continuous-shot driving mode," the change rod 16 is at the continuous-shot position and, by operating the trigger lever 11, the trigger plunger 21 can certainly be moved by the upper surface 13*a* of the trigger arm 13.

When the stopper 17 is rotated again in the direction of the arrow 19*b* from the state of FIG. 7(*c*), in order to retract the front piece 17*a* of the stopper 17 to the upper side from the inside of the guiding groove 15 in the side view, the operator can move the change rod 16 from the front to the rear side, as indicated by the arrow, and consequently it returns to the state of FIG. 7(*a*). In this way, the driving modes can be switched by moving the change rod 16 to the front end or the rear end in the state where the stopper 17 is operated and rotated, as indicated by the arrow 19*b*. Moreover, since the driving switching mechanism can be implemented by the trigger arm 13, the rotating shaft 14, the stopper 17, and the spring (not shown), the driving switching mechanism of this embodiment can be easily achieved simply by modifying part of the trigger 10.

Figures 8A, 8B, 8C:
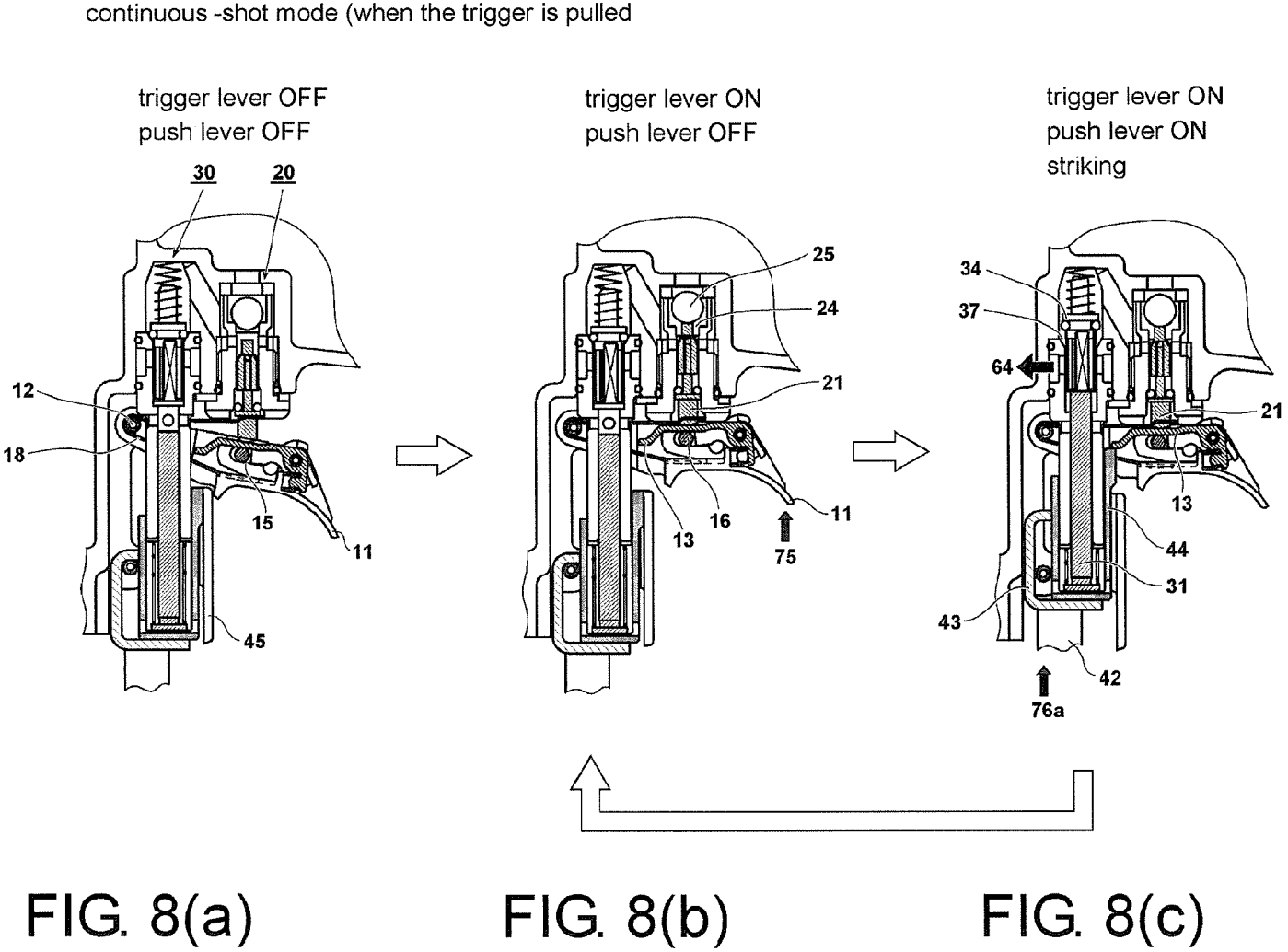
FIG. 8(*a*) to FIG. 8(*c*) are views showing the operations of the first switch 20 and the second switch 30 in the case of the continuous-shot driving mode (1 thereof).
Figures 13A, 13B, 13C:
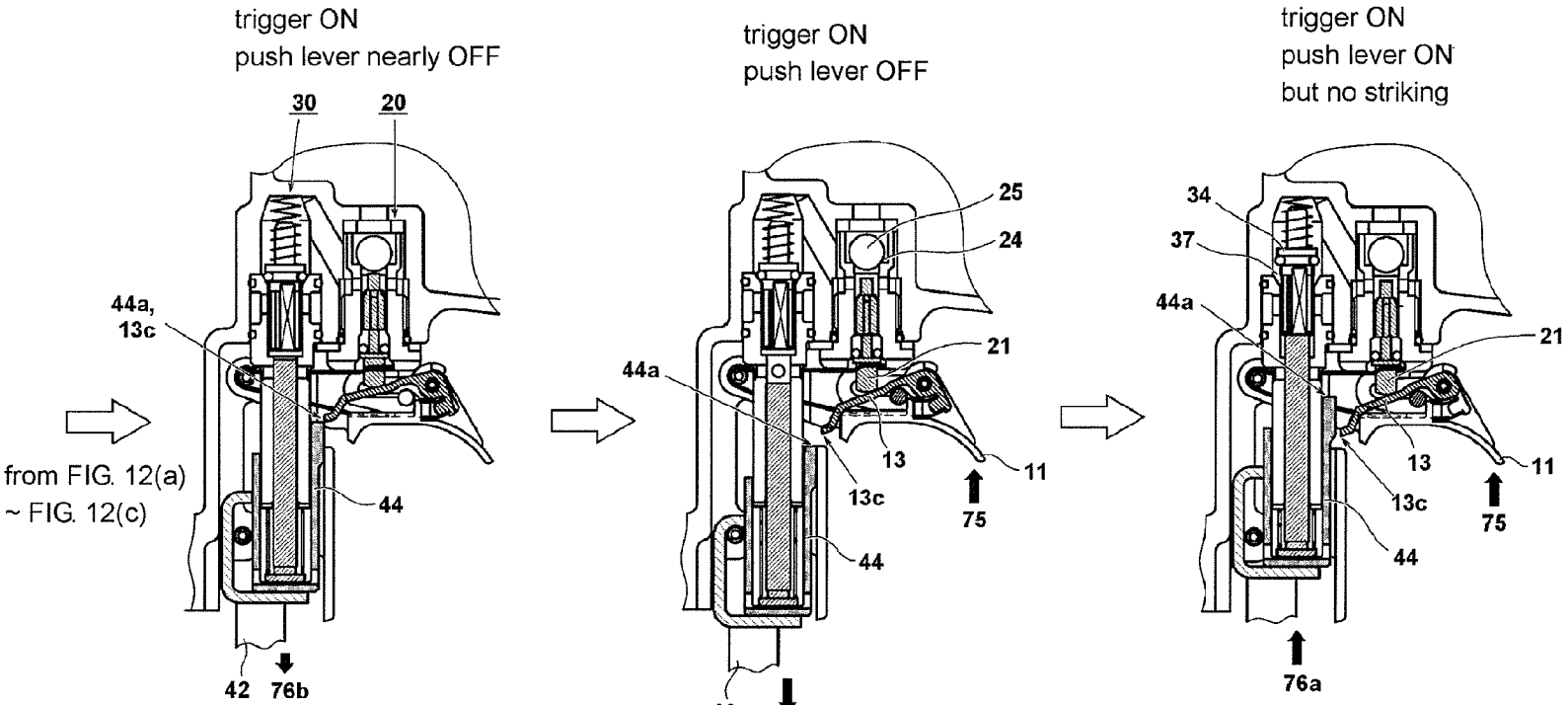
FIG. 13(*a*) to FIG. 13(*c*) are views showing the operations of the first switch 20 and the second switch 30 in the case of the single-shot driving mode (2-2 thereof).

Next, the operations of the trigger 10, the first switch 20, and the second switch 30 during the driving operation are described with reference to FIG. 8(*a*) to FIG. 13(*c*). FIG. 8(*a*) to FIG. 8(*c*) are views showing the operation when the change rod 16 is set to the position of FIG. 7(*c*) in the guiding groove 15 to switch to the "continuous-shot driving mode." FIG. 8(*a*) illustrates a state where the trigger 10 is not pulled (OFF) and the push lever 40 is not pressed against the driven material, either (OFF). The state of FIG. 8(*b*) is when the trigger lever 11 is initially pulled in the direction of the arrow 75 after the aforementioned state. Here, because the change rod 16 is at the front side of the guiding groove 15, the trigger arm 13 has moved to the upper side. Thus, it becomes the state that the trigger plunger 21 is moved to the upper side by the upper surface 13*a* of the trigger arm 13. Then, the valve member 25 is moved to the upper side by the trigger plunger 21 and is separated from the opening 24. Therefore, the first switch 20 becomes the communicating state (ON state).

Next, when the main body of the driving machine 1 is moved and the front end member 41 of the push lever 40 is pressed against the driven material, the connection arm 42 of the push lever 40 moves to the upper side, as indicated by the arrow 76*a*, and thus the push lever plunger 31 moves the push lever valve 34 upward, by which the opening 37 is opened. Therefore, the compressed air flows in the direction of the arrow 64 and thus the nail can be struck. In this way, even if the trigger lever 11 is pulled first as shown in FIG. 8(*a*) to FIG. 8(*b*), the push lever 40 is pressed against the driven material to set both the first switch 20 and the second switch 30 to the ON state (the state where the valve is opened), as shown in FIG. 8(*b*) to FIG. 8(*c*). Thus, the striking of the nail can be carried out.

When the striking of the nail is carried out, the reaction thereof causes a reaction force to be transmitted to move the driving machine 1 to the side opposite to the driving direction. Therefore, the push lever 40 is separated from the driven material by the reaction force and returns to the state of FIG. 8(*b*). However, by maintaining the state of pulling the trigger lever 11 and moving the main body of the driving machine 1 to press the push lever 40 against the driven material at the next striking position, the compressed air is discharged from the trigger mechanism, as indicated by the arrow 64. Thus, striking of the nail is carried out. Thereafter, in the state of keeping the trigger lever 11 pulled, the states of FIG. 8(*b*) and FIG. 8(*c*) are repeated, that is, the operation of pressing the push lever 40 against the driven material and the operation of releasing the push lever 40 are repeated. Thereby, the nails can be struck continuously until the trigger lever 11 is released.

Figures 9A, 9B, 9C:
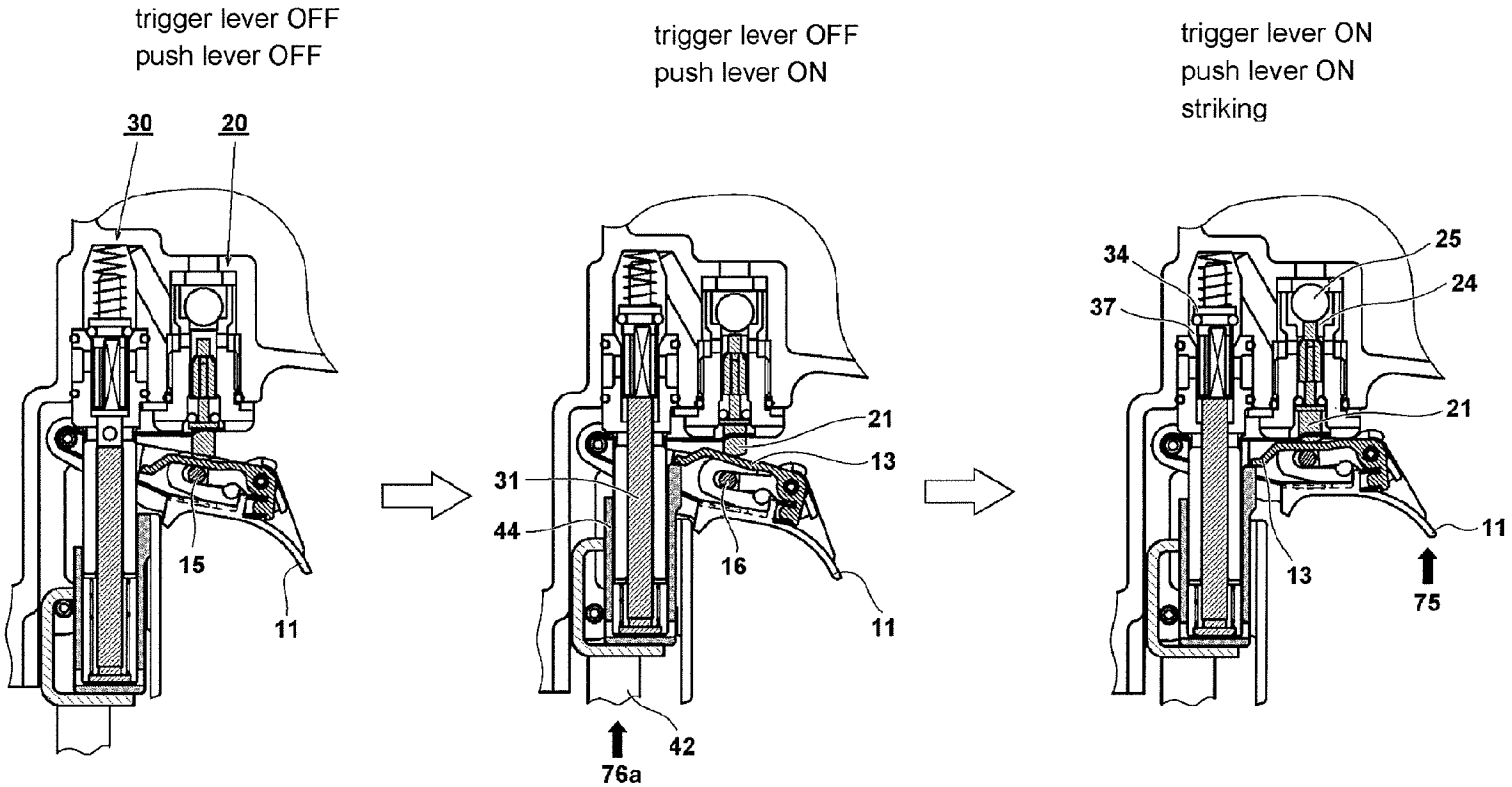
FIG. 9(*a*) to FIG. 9(*c*) are views showing the operations of the first switch 20 and the second switch 30 in the case of the continuous-shot driving mode (2-1 thereof).
Figures 10A, 10B:
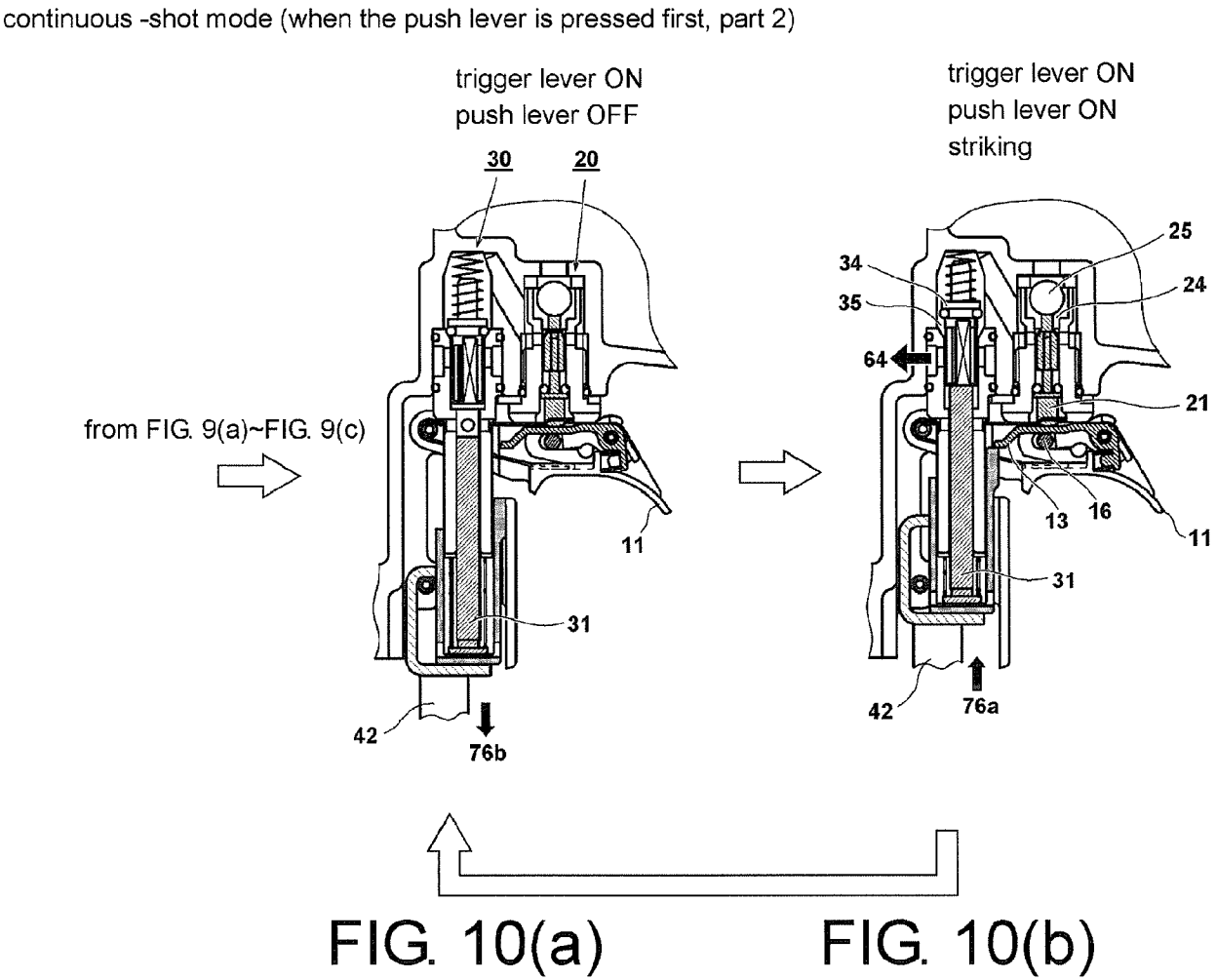
FIG. 10(*a*) and FIG. 10(*b*) are views showing the operations of the first switch 20 and the second switch 30 in the case of the continuous-shot driving mode (2-2 thereof).

Next, the striking method for a situation where the push lever 40 is pressed against the driven material first in the "continuous-shot driving mode" is described with reference to FIG. 9(*a*) to FIG. 10(*b*). Here, FIG. 9(*a*) illustrates a state where the trigger 10 is not pulled (OFF) and the push lever 40 is not pressed against the driven material, either (OFF). FIG. 9(*b*) illustrates a state where the push lever 40 is pressed against the driven material first after the aforementioned state. In this state, the side of the second switch 30 is turned on. However, because the trigger lever 11 has not been pulled, the side of the first switch 20 is not turned on. Then, when the operator pulls the trigger lever 11 in the direction of the arrow 75, the trigger plunger 21 is pressed by the upper surface of the trigger arm 13 to move the valve member 25 upward, such that the opening 24 becomes the communicating state and the side of the first switch 20 becomes the communicating state (ON state) as well. In this way, even if the push lever 40 is pressed against the driven material first as shown in FIG. 9(*a*) to FIG. 9(*c*), by pulling the trigger lever 11 in the direction of the arrow 75, the first switch 20 and the second switch 30 are both set to the ON state (the state where the valve is opened), as shown in FIG. 9(*c*). Therefore, the striking of the nail can be carried out.

When the striking of the nail is carried out, the reaction thereof causes a reaction force to be transmitted to move the driving machine 1 to the side opposite to the driving direction. The push lever 40 moves away from the driven material due to the reaction force. Hence, the push lever 40 is moved in the direction of the arrow 76*b* by the urging force of a spring 46 (refer to FIG. 2), as shown in FIG. 10(*a*). However, if the trigger lever 11 remains to be pulled, the position of the trigger arm 13 remains at the second position, so as to maintain the first switch 20 in the operable state. As a result, by moving the main body of the driving machine 1 and pressing the push lever 40 against the driven material at the next striking position, the next striking can be carried out, as shown in FIG. 10(*b*). Afterward, by repeating the states of FIG. 10(*a*) and FIG. 10(*b*), the nails can be continuously struck until the trigger lever 11 is released.

Figures 11A, 11B, 11C:
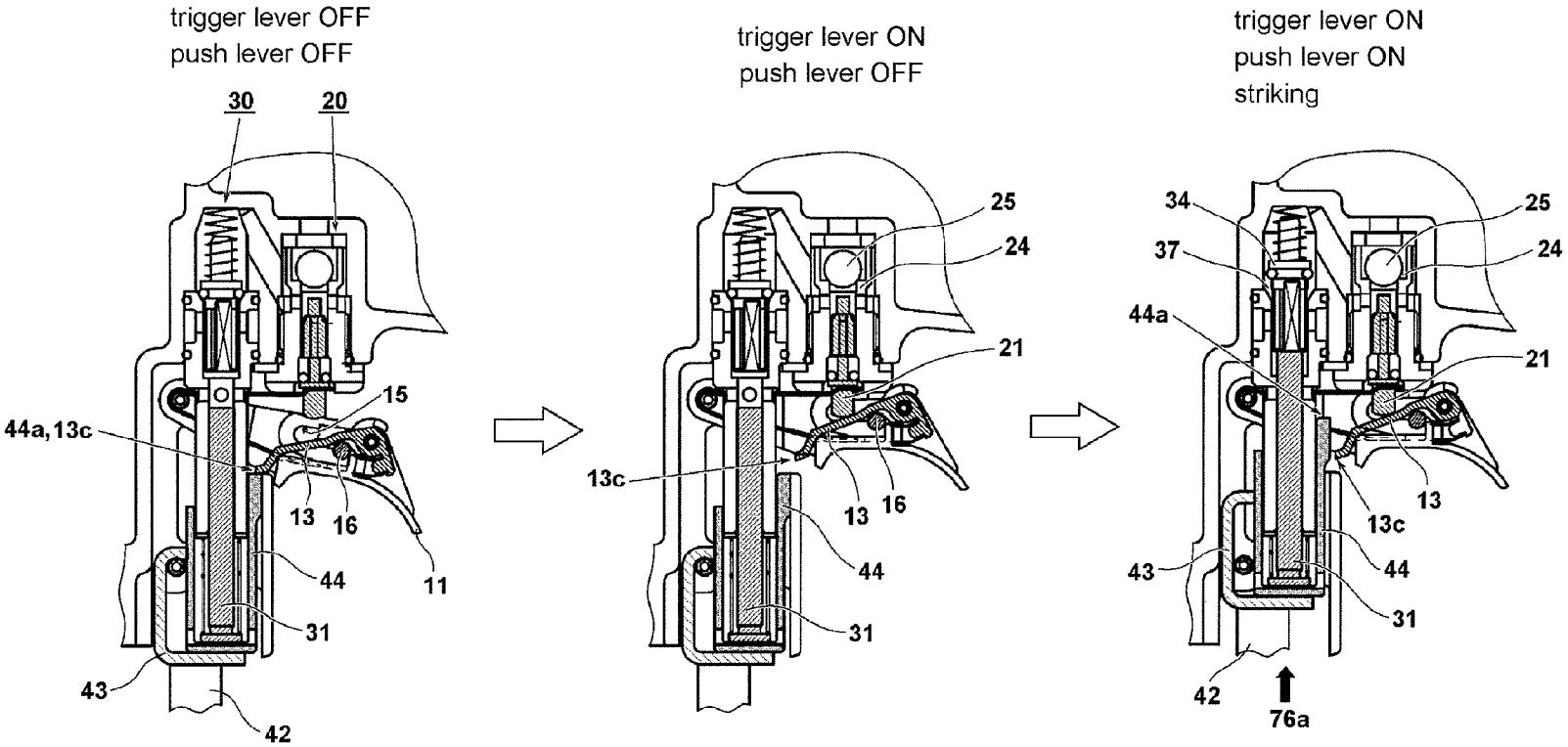
FIG. 11(*a*) to FIG. 11(*c*) are views showing the operations of the first switch 20 and the second switch 30 in the case of the single-shot driving mode (1 thereof).

Next, the operation of the "single-shot driving mode" is described with reference to FIG. 11(*a*) to FIG. 11(*c*). In the states of FIG. 11(*a*) to FIG. 11(*c*), the change rod 16 is positioned on the rear side of the guiding groove 15, which is different from the positions of FIG. 8(*a*) to FIG. 10(*b*). In the "single-shot driving mode," the push lever 40 is pressed against the driven material and then the trigger lever 11 is pulled to carry out the striking. Therefore, the striking is not carried out if the push lever 40 is pulled in the reverse order. FIG. 11(*a*) to FIG. 11(*c*) illustrate a situation that is reverse. In FIG. 11(*a*), the push lever 40 and the trigger lever 11 are both in the OFF state. In this state, even if the trigger lever 11 is pulled first, the trigger arm 13 has rotated counter-clockwise in the figure as shown in FIG. 11(*b*) and therefore the trigger plunger 21 cannot be pressed to set the first switch 20 to the communicating state (ON state). Moreover, in this state, even if the push lever 40 is pressed against the driven material to move the connection arm 42 as indicated by the arrow 76*a*, an upper end 44*a* of the substantially cylindrical sleeve 44 and a front end part 13*c*, which serves as the swing end of the trigger arm 13, are not in contact and do not interfere with each other, as shown in FIG. 11(*c*), and therefore the trigger arm 13 does not swing and remains at the same position. Accordingly, even though the side of the second switch 30 is in the connection state, the side of the first switch 20 remains to be blocked and thus the driving operation is not performed. Therefore, in the "single-shot driving mode," if the trigger lever 11 is not pulled after the push lever 40 is pressed against the driven material, the striking operation cannot be carried out. Hence, concerns about unintentional continuous shots are eliminated.

Figure 12A:
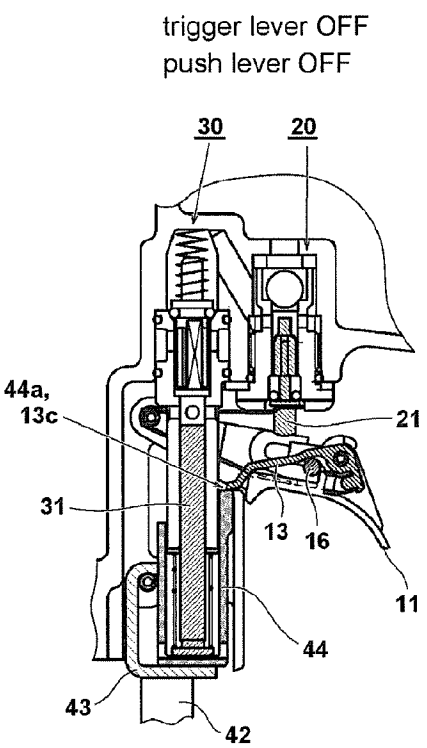
FIG. 12(*a*) to FIG. 12(*c*) are views showing the operations of the first switch 20 and the second switch 30 in the case of the single-shot driving mode (2-1 thereof).
Figure 12B:
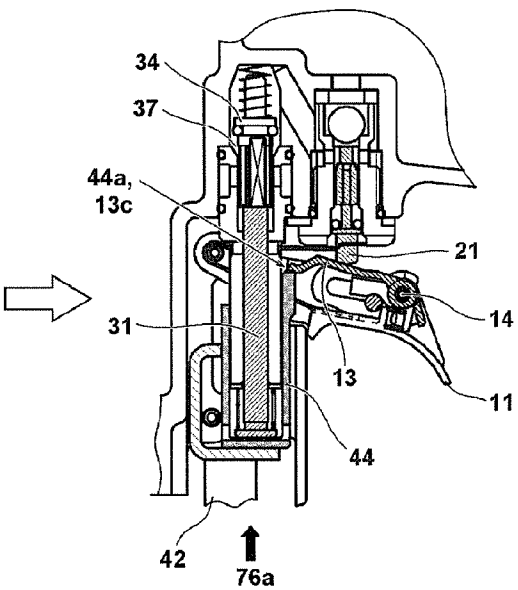
Figure 12C:
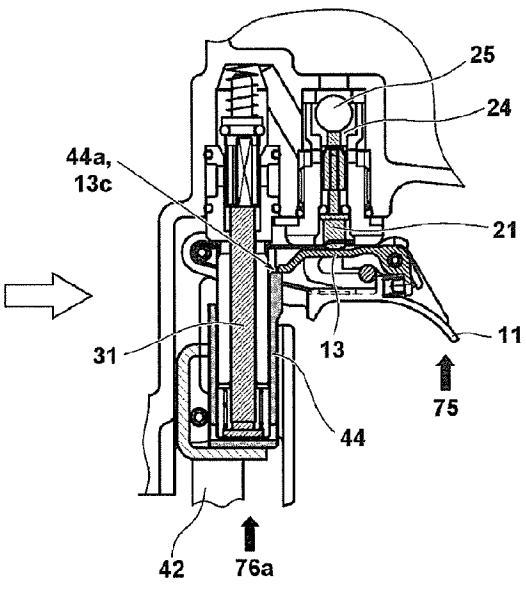

Next, the striking operation of the "single-shot driving mode" is described with reference to FIG. 12(*a*) to FIG. 13(*c*). In the states of FIG. 12(*a*) to FIG. 13(*c*), the change rod 16 is positioned on the rear side of the guiding groove 15. FIG. 12(*a*) to FIG. 13(*c*) illustrate the correct operation, that is, in the "single-shot driving mode," the push lever 40 is pressed against the driven material and then the trigger lever 11 is pulled. In FIG. 12(*a*), the push lever 40 and the trigger lever 11 are both in the OFF state. In this state, when the push lever 40 is pressed against the driven material first, as shown in FIG. 12(*b*), the connection arm 42 moves upward, as indicated by the arrow 76*a*, and the second switch 30 is turned on. In the meantime, the upper end 44*a* of the sleeve 44 connected to the push lever 40 pushes the front end part 13*c* of the trigger arm 13 from the lower side to the upper side, such that the trigger arm 13 rotates clockwise around the rotating shaft 14. In this state, when the trigger lever 11 is pulled, the trigger arm 13 is positioned on the upper side due to interference with the upper end 44*a* of the sleeve 44, as shown in FIG. 12(*c*), and the trigger plunger 21 can be pressed to set the side of the first switch 20 also to ON to carry out the striking.

When the striking of the nail is carried out, the reaction thereof causes a reaction force to be transmitted to move the driving machine 1 to the side opposite to the driving direction. Thus, the push lever 40 moves away from the driven material due to the reaction force. Hence, the push lever 40 is moved in the direction of the arrow 76*b* by the urging force of the spring 46 (refer to FIG. 2), as shown in FIG. 13(*a*), and returns to the state of FIG. 13(*b*) via the state of FIG. 13(*a*). At the moment, as shown in FIG. 13(*a*), the sleeve 44 is lowered to release the upper end 44*a* of the sleeve 44 from the state of engagement with the front end part 13*c* of the trigger arm 13. In the state of FIG. 13(*b*), despite that the operator keeps the trigger lever 11 pulled, the trigger arm 13 rotates counterclockwise in the figure and therefore the trigger plunger 21 is lowered to set the first switch 20 to OFF. Here, it returns to the state of FIG. 12(*a*) if the trigger lever 11 is returned. However, if the main body of the driving machine 1 is moved to press the push lever 40 against the driven material at the next striking position while the trigger lever 11 is not returned, as shown in FIG. 13(*c*), since the upper end 44*a* of the sleeve 44 and the front end part 13*c* of the trigger arm 13 are not in contact and do not interfere with each other, the trigger arm 13 cannot be rotated and remains at the same position. Accordingly, even though the side of the second switch 30 is in the connection state, the side of the first switch 20 remains to be blocked and thus the striking operation is not carried out. Therefore, in the "single-shot driving mode," if the trigger lever 11 is not pulled after the push lever 40 is pressed against the driven material, the striking operation cannot be carried out. Furthermore, after the striking is completed, the next striking operation cannot be carried out if the trigger lever 11 is not returned temporarily. Thus, single shot driving can be performed reliably.

According to this embodiment, the driving switching mechanism is disposed on the side of the trigger lever 11. Therefore, the configuration of the invention can be easily achieved by only modifying the trigger 10. Moreover, because the driving switching mechanism can be implemented by the trigger arm 13, the change rod 16, and the guiding groove 15, the compact switching mechanism can be achieved with a simple mechanism.

Although the invention has been described above based on the embodiments, the invention should not be construed as limited to the aforementioned embodiments, and various modifications may be made without departing from the spirit of the invention. For example, in the embodiment described above, the driving switching mechanism is achieved by using the swing type trigger arm that is disposed on the rotating shaft 40. However, other types of movable members, such as a slide type movable member, may be used as the trigger arm and the switching mechanism may be disposed thereon. Moreover, the above embodiment illustrates a case of using the compressed air as the striking driving element. Nevertheless, the first switch and the second switch may be implemented by electric switch mechanisms, so as to use a combustion type gas or an electric motor.

What is claimed is:

1. A driving machine, comprising:

a driver blade that strikes a fastener;

a striking driving element comprising compressed air, which causes the driver blade to reciprocate;

a first switch for activating the striking driving element;

a trigger operated by an operator to set the first switch to an ON state or an OFF state;

a push lever supported to be movable in a direction parallel to a movement direction of the driver blade and moving in response to an operation of pressing a front end of an ejection port of the fastener against a driven material; and wherein the trigger comprises a driving switching mechanism to switch between a continuous-shot driving mode, in which the first switch is set to the ON state while the trigger is pulled, and a single-shot driving mode, in which the first switch is set to the ON state while the trigger is pulled after the push lever being pressed against the driven material, and the first switch is set to the OFF state while the trigger is pulled before the push lever being pressed against the driven material.

2. The driving machine according to claim 1, wherein the trigger comprises a trigger lever that is swingable around a swing shaft, the driving switching mechanism comprises a movable member that is disposed in the trigger lever and is in contact with a plunger of the first switch, and the movable member is movable relative to the trigger lever and is able to be positioned at a first position where the plunger is not operated by an operation of the trigger lever and a second position where the plunger is operated by the operation of the trigger lever.

3. The driving machine according to claim 2, wherein the striking driving element moves a piston that is connected to the driver blade by the compressed air, the first switch is a switching valve of an air flow path, which serves as a trigger to supply the compressed air to the piston, and is operated by the trigger lever, and the second switch is a switching valve interposed in series in the air flow path and performs opening and closing operations by the movement of the push lever.

4. The driving machine according to claim 2, wherein in the single-shot driving mode, after the fastener is driven, the movable member moves from the second position to the first position, such that the first switch is not operated; and in the continuous-shot driving mode, after the fastener is driven, the movable member remains at the second position to maintain the first switch in an operable state.

5. The driving machine according to claim 4, wherein the movable member is of a swing type and is swingable by a predetermined angle around a rotating shaft that is disposed in the trigger lever, a direction in which a swing end of the trigger lever extends from the swing shaft and a direction in which a swing end of the movable member extends from the rotating shaft are opposite directions, and a switching member is disposed in the trigger lever to allow or prevent swing of the movable member.

6. The driving machine according to claim 5, wherein the switching member is of a rod type that is disposed substantially in parallel to the rotating shaft, wherein a guiding groove is disposed to partially overlap a swing range of the movable member when viewed in an axial direction of the rotating shaft, and the switching member is moved inside the guiding groove in a longitudinal direction of the movable member, so as to set one of a single-shot position and a continuous-shot position, wherein the single-shot position is where the movable member is movable between the first position and the second position, and the continuous-shot position is where the movable member is fixed to the second position.

7. The driving machine according to claim 6, wherein in the single-shot driving mode, if the trigger is operated after the push lever is pressed against the driven material, the movable member moves from the first position to the second position due to contact with the push lever to be able to move the plunger of the first switch; and if the trigger is operated before the push lever is pressed against the driven material, because the movable member and the push lever are in a non-contact state, the movable member remains at the first position and is not able to move the plunger of the first switch.

8. The driving machine according to claim 7, wherein when the fastener is driven in the single-shot driving mode, the movable member and the push lever are released from a contact state by releasing the push lever from a state of being pressed against the driven material, and the movable member returns to the first position from the second position by a force of an urging spring.

9. The driving machine according to claim 1, wherein the trigger comprises a trigger lever which moves due to a pulling operation performed by the operator, the driving switching mechanism comprises a movable member, which moves together with the trigger lever and is capable of pressing against the first switch, and a switching member, which changes a position of the movable member relative to the trigger lever in a case when switching to the single-shot driving mode and the continuous-shot driving mode.

10. A driving machine, comprising:

a driver blade that strikes a fastener;

a striking driving element comprising compressed air, which serves as a driving source to cause the driver blade to reciprocate;

a first switch for activating the striking driving element;

a trigger operated by an operator to set the first switch to an ON state or an OFF state;

a push lever supported to be movable in a direction parallel to a movement direction of the driver blade and moving in response to an operation of pressing a front end of an ejection port of the fastener against a driven material;

a movable member that is disposed in the trigger and is in contact with a plunger of the first switch, wherein the trigger comprises a driving switching mechanism to switch between a continuous-shot driving mode, in which the first switch is set to the ON state while the trigger is pulled, and a single-shot driving mode, in which the first switch is set to the ON state while the trigger is pulled after the push lever being pressed against the driven material, and the first switch is set to the OFF state while the trigger is pulled before the push lever being pressed against the driven material, wherein a guiding groove is disposed to partially overlap the movable member, a switching member inside the guiding groove is moved in a longitudinal direction of the movable member and sets the movable member to be in one of a single-shot position and a continuous-shot position.

* * * * *